US010301893B2

(12) United States Patent
Folmar et al.

(10) Patent No.: US 10,301,893 B2
(45) Date of Patent: May 28, 2019

(54) SHALE-GAS SEPARATOR DISCHARGE DIFFUSER

(71) Applicant: Seaboard International Inc., Houston, TX (US)

(72) Inventors: Stephen Folmar, The Village, OK (US); Harold Dean Mathena, Edmond, OK (US)

(73) Assignee: Seaboard International Inc., Houston, TX (US)

( * ) Notice: Subject to any disclaimer, the term of this patent is extended or adjusted under 35 U.S.C. 154(b) by 53 days.

(21) Appl. No.: 15/296,572

(22) Filed: Oct. 18, 2016

(65) Prior Publication Data

US 2017/0107772 A1 Apr. 20, 2017

Related U.S. Application Data

(60) Provisional application No. 62/243,437, filed on Oct. 19, 2015.

(51) Int. Cl.
*B07B 1/28* (2006.01)
*E21B 21/06* (2006.01)

(52) U.S. Cl.
CPC ..... *E21B 21/065* (2013.01); *B07B 1/28* (2013.01); *E21B 21/067* (2013.01)

(58) Field of Classification Search
CPC ..... E21B 21/065; E21B 21/067; B07B 1/28
See application file for complete search history.

(56) References Cited

U.S. PATENT DOCUMENTS 2,177,560 A * 10/1939 Coogan ..... E21B 21/065 210/383
8,784,545 B2 7/2014 Mathena

FOREIGN PATENT DOCUMENTS

WO WO 2012/141691 10/2012

* cited by examiner

*Primary Examiner* — Randy Boyer
*Assistant Examiner* — Juan C Valencia
(74) *Attorney, Agent, or Firm* — Wei Wei Jeang; Grable Martin Fulton PLLC

(57) ABSTRACT

According to one aspect, a diffuser apparatus includes a first pipe having a first plurality of openings formed therein, the first pipe defining a first passageway that is adapted to receive a first portion of debris that is discharged from a well; a first housing within which the first pipe extends, the first housing comprising a first wall and a first outlet formed therein; and a first region formed between the first pipe and the first housing, the first region in communication with the first passageway via the first plurality of openings; wherein the first plurality of openings are circumferentially and axially spaced along the first pipe to pass the first portion of the debris from the first passageway to the first region; and wherein the first outlet is sized such that the first portion of the debris exits the first region via the first outlet.

16 Claims, 6 Drawing Sheets

SHALE-GAS SEPARATOR DISCHARGE DIFFUSER

CROSS-REFERENCE TO RELATED APPLICATION

This application claims the benefit of the filing date of, and priority to, U.S. Application No. 62/243,437, filed Oct. 19, 2015, the entire disclosure of which is hereby incorporated herein by reference.

TECHNICAL FIELD

This disclosure relates in general to shale-gas separator systems and, in particular, to a shale-gas separator discharge diffuser.

BACKGROUND OF THE DISCLOSURE

During the drilling of an oil or gas well, different materials may be discharged from the well. The discharged materials may include mixtures of solid, liquid, and gas materials. The discharged materials may be conveyed through different vessels and vent lines of a shale-gas separator system, which is located at the drilling rig site. Examples of such vessels may include mud-gas separator vessels, shale-gas separator vessels, mud-containment vessels, or any combination thereof. In many cases, the material, or debris, exits the shale-gas separator and is discharged into a collection bin. However, the shale-gas separator system may be bypassed and the debris may be discharged directly into the collection bin. If the debris exits the system or the well at a high velocity, then the debris may ricochet off a wall of the collection bin and into an area surrounding the collection bin. Alternatively, the debris may enter the collection bin with a force sufficient to splash or eject debris, which is already disposed in the collection bin, from the collection bin to a location outside the collection bin. Debris that exits the collection bin may damage or dirty surrounding equipment, pose a danger to nearby personnel, create slip hazards, and may result in creating a hazardous air quality condition. Additionally, the entire volume of the collection bin may not be utilized when the debris is not distributed uniformly along a length of the bin. Therefore, what is needed is a system, method, kit, apparatus, or assembly that addresses one or more of these issues, and/or other issue(s).

SUMMARY

In a first aspect, there is provided a discharge diffuser apparatus, the discharge diffuser apparatus includes a first pipe having a first plurality of openings formed therein, the first pipe defining a first passageway that is adapted to receive debris discharged from a well; a first housing within which the first pipe extends, the first housing including a first wall and a first outlet formed therein; and a first region formed between the first pipe and the first housing, the first region being in communication with the first passageway via the first plurality of openings; wherein the first plurality of openings are circumferentially and axially spaced along the first pipe to pass a first portion of the debris from the first passageway to the first region; and wherein the first outlet is sized such that the first portion of the debris exits the first region via the first outlet.

In an exemplary embodiment, one opening from the first plurality of openings defines a first area; the first pipe defines a first inner diameter; and the first area is a function of the first inner diameter.

In another exemplary embodiment, the first housing includes a first end cap that extends radially between the first wall of the first housing and the first pipe; and a second opposing end cap that extends radially between the first wall of the first housing and the first pipe; and the first and second end caps at least partially define the first region.

In yet another exemplary embodiment, the discharge diffuser apparatus further includes: a second pipe having a second plurality of openings formed therein, the second pipe defining a second passageway that is adapted to receive debris that is discharged from the well; a second housing within which the second pipe extends, the second housing including a second wall and a second outlet formed therein; and a second region formed between the second pipe and the second housing, the second region being in communication with the second passageway via the second plurality of openings; wherein the second plurality of openings are circumferentially and axially spaced along the second pipe to pass a second portion of the debris from the second passageway to the second region; and wherein the second outlet is sized such that the second portion of the debris exits the second region via the second outlet.

In certain exemplary embodiments, one opening from the second plurality of openings defines a second area that is less than the first area; the second pipe defines a second inner diameter that is less than the first inner diameter; and the second area is a function of the second inner diameter.

In an exemplary embodiment, the first outlet and the second outlet are arranged in series and are spaced along a length of a collection bin that is configured to receive the first portion of debris and the second portion of debris.

In another exemplary embodiment, the first outlet and the second outlet are arranged in series and spaced such that the first outlet is positioned above an inlet of a first shaker and the second outlet is positioned above an inlet of a second shaker.

In yet another exemplary embodiment, the first pipe is adapted to be detachably coupled to the second pipe and the second pipe is adapted to be detachably coupled to the first pipe, and the discharge diffuser apparatus further comprises a double flanged reducer that detachably couples the first pipe to the second pipe.

In certain exemplary embodiments, the apparatus is adapted to be coupled to one or more of the following: a discharge outlet of a shale-gas separator that is in communication with the well; a bypass pipe that is in communication with the well; and an overflow port of the shale-gas separator; and wherein the first passageway is in communication with one or more of the following: the discharge outlet of the shale-gas separator; the bypass pipe; and the overflow port of the shale-gas separator.

In a second aspect, there is provided a debris discharge diffuser system, the system including: a first diffuser adapted to be in communication with a well, the first diffuser including: a first pipe having a first plurality of openings formed therein and defining a first passageway that is adapted to receive debris that is discharged from the well; a first housing within which the first pipe extends, the first housing including a first wall and a first outlet formed therein; and a first region formed between the first pipe and the first housing, the first region being in communication with the first passageway via the first plurality of openings; wherein the first region is adapted to receive a first portion of the debris that is discharged from the well via the first plurality of openings; a second diffuser adapted to in communication with the well via the first diffuser, the second diffuser including: a second pipe having a second plurality of openings formed therein and defining a second passageway that is adapted to receive debris that is discharged from the well via the first pipe; a second housing within which the second pipe extends, the second housing including a second wall and a second outlet formed therein; and a second region formed between the second pipe and the second housing, the second region being in communication with the second passageway via the second plurality of openings; wherein the second region is adapted to receive a second portion of the debris that is discharged from the well via the second plurality of openings; wherein the first pipe is configured to be coupled to the second pipe such that the first passageway is in communication with the second passageway; and wherein the first pipe defines a first inner diameter and the second pipe defines a second inner diameter that is less than the first inner diameter.

In an exemplary embodiment, the system is adapted to be coupled to one or more of the following: a discharge outlet of a shale-gas separator that is in communication with the well; a bypass pipe that is in communication with the well; and an overflow port of the shale-gas separator; and wherein the first passageway is in communication with one or more of the following: the discharge outlet of the shale-gas separator; the bypass pipe; and the overflow port of the shale-gas separator.

In an exemplary embodiment, the first plurality of openings are circumferentially and axially spaced along the first pipe to pass the first portion of the debris from the first passageway to the first region; the first outlet is sized such that the first portion of the debris exits the first region via the first outlet; the second plurality of openings are circumferentially and axially spaced along the second pipe to pass the second portion of the debris from the second passageway to the second region; and the second outlet is sized such that the second portion of the debris exits the second region via the second outlet.

In another exemplary embodiment, the first diffuser and the second diffuser are arranged in series along a longitudinal axis of the debris discharge diffuser system such that the first outlet is longitudinally spaced from the second outlet; the debris discharge diffuser system further includes: a collection bin located below the first diffuser and the second diffuser to receive the first portion of the debris and the second portion of the debris; and a connector extending between the collection bin and at least one of the first diffuser and the second diffuser such that the first outlet and the second outlet are spaced along a length of the collection bin.

In yet another exemplary embodiment, the first housing includes: a first end cap that extends radially between the first wall of the first housing and the first pipe; and a second opposing end cap that extends radially between the first wall of the first housing and the first pipe; wherein the first and second end caps at least partially define the first region; wherein the second housing includes: a third end cap that extends radially between the second wall of the second housing and the second pipe; and a fourth opposing end cap that extends radially between the second wall of the second housing and the second pipe; and wherein the third and fourth end caps at least partially define the second region.

In certain embodiments, one opening from the first plurality of openings defines a first area; the first area is a function of the first inner diameter; one opening from the second plurality of openings defines a second area that is less than the first area; and the second area is a function of the second inner diameter.

In an exemplary embodiment, the first outlet and the second outlet are arranged in series along a longitudinal axis of the debris discharge diffuser system and spaced such that the first outlet is positioned above an inlet of a first shaker and the second outlet is positioned above an inlet of a second shaker.

In another exemplary embodiment, the debris discharge diffuser system further includes a double flanged reduced that couples the first pipe to the second pipe such that the first passageway is in communication with the second passageway.

In a third aspect, there is provided a method of discharging debris from a well, the method including: receiving debris from the well in a discharge diffuser apparatus, the discharge diffuser apparatus including a first diffuser and a second diffuser that are arranged in series; discharging a first portion of the debris at a first velocity from the first diffuser; and discharging a second portion of the debris at a second velocity from the second diffuser.

In an exemplary embodiment, the second velocity is equal to, or within 50% of, the first velocity.

In an exemplary embodiment, the first diffuser includes a first pipe defining a first pipe diameter and a first passageway; the second diffuser includes a second pipe that is in communication with the first pipe, the second pipe defining a second pipe diameter that is less than the first pipe diameter and a second passageway; and receiving the debris from the well in the discharge diffuser apparatus includes: receiving the first portion of the debris in the first passageway; and receiving the second portion of the debris in the second passageway.

In another exemplary embodiment, the first pipe has a first plurality of openings formed therein; the first diffuser further includes: a first housing within which the first pipe extends, the first housing including a first wall and a first outlet formed therein; and a first region formed between the first pipe and the first housing, the first region being in communication with the first passageway via the first plurality of openings; wherein the first plurality of openings are circumferentially and axially spaced along the first pipe to pass the first portion of the debris from the first passageway to the first region; wherein the first outlet is sized such that the first portion of the debris exits the first region via the first outlet; wherein the second pipe has a second plurality of openings formed therein; wherein the second diffuser further includes: a second housing within which the second pipe extends, the second housing including a second wall and a second outlet formed therein; and a second region formed between the second pipe and the second housing, the second region being in communication with the second passageway via the second plurality of openings; wherein the second plurality of openings are circumferentially and axially spaced along the second pipe to pass the second portion of the debris from the second passageway to the second region; and wherein the second outlet is sized such that the second portion of the debris exits the second region via the second outlet.

In yet another exemplary embodiment, the method also includes coupling the discharge diffuser apparatus to a collection bin such that the first outlet and the second outlet are spaced along a length of the collection bin to distribute the first portion of the debris that exits the first outlet and the second portion of the debris that exists the second outlet along the length of the collection bin.

In certain exemplary embodiments, the method also includes spacing the first outlet from the second outlet along a longitudinal axis of the discharge diffuser apparatus such that the first outlet is positioned above an inlet of a first shaker and the second outlet is positioned above an inlet of a second shaker.

In an exemplary embodiment, one opening of the first plurality of openings defines a first area that is a function of the first inner diameter; and one opening of the second plurality of openings defines a second area that is a function of the second inner diameter and that is less than the first area.

In another exemplary embodiment, the first housing further includes: a first end cap that extends radially between the first wall of the first housing and the first pipe; and a second opposing end cap that extends radially between the first wall of the first housing and the first pipe; wherein the first and second end caps at least partially define the first region; wherein the second housing further includes: a third end cap that extends radially between the second wall of the second housing and the second pipe; and a fourth opposing end cap that extends radially between the second wall of the second housing and the second pipe; and wherein the third and fourth end caps at least partially define the second region.

In another exemplary embodiment, wherein receiving debris from the well in a discharge diffuser apparatus includes receiving the debris in the discharge diffuser apparatus from at least one of: a discharge outlet of a shale-gas separator that is in communication with the well; a bypass pipe that is in communication with the well; and an overflow port of the shale-gas separator.

Other aspects, features, and advantages will become apparent from the following detailed description when taken in conjunction with the accompanying drawings, which are a part of this disclosure and which illustrate, by way of example, principles of the inventions disclosed.

DESCRIPTION OF FIGURES

The accompanying drawings facilitate an understanding of the various embodiments.

DETAILED DESCRIPTION

Figure 1:
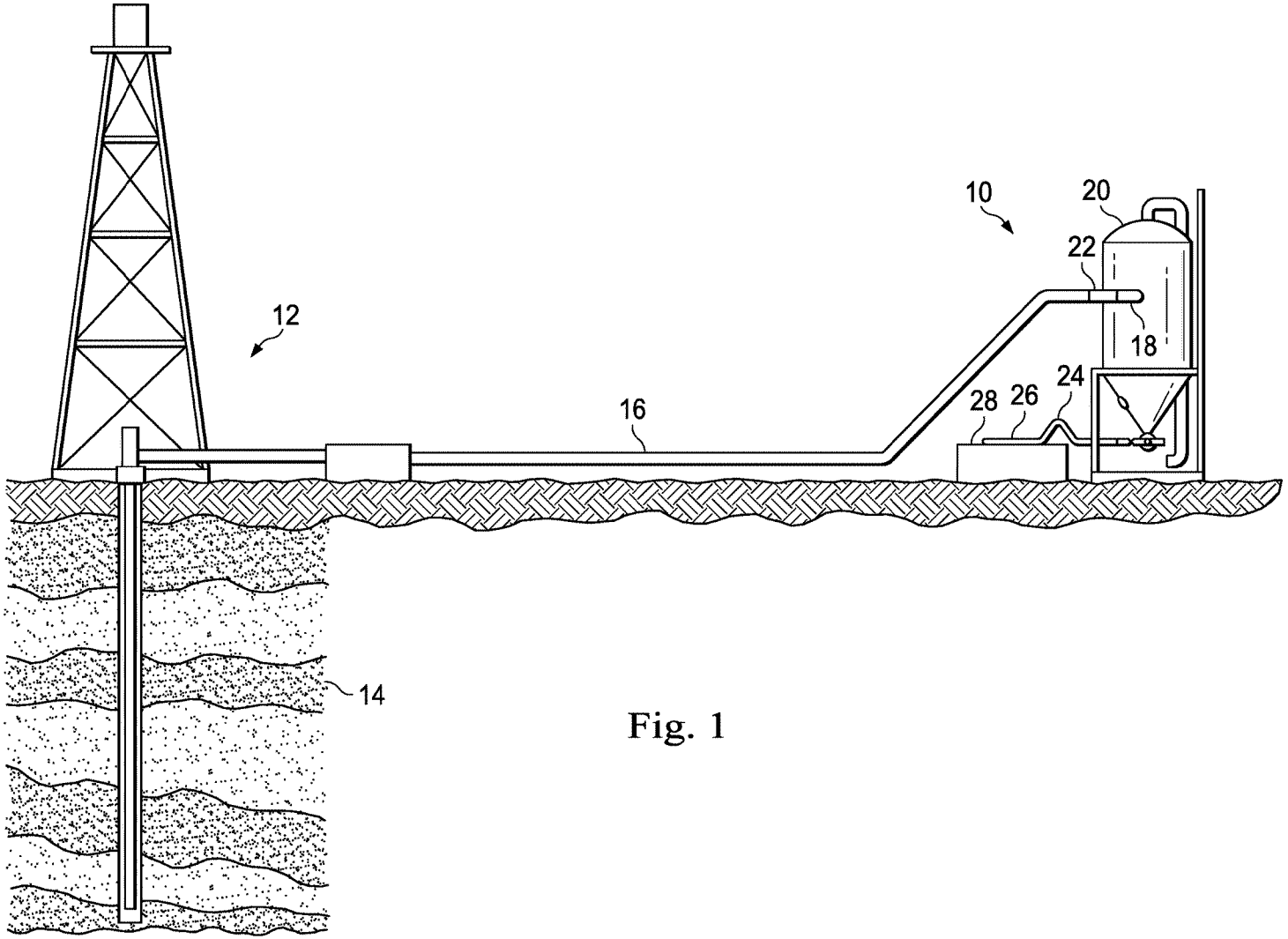
FIG. 1 is a diagrammatic illustration of a separator in communication with a well according to an exemplary embodiment, the separator including a discharge line, a diffuser system, and a receptacle.

In an exemplary embodiment and as illustrated in FIG. 1, a shale-gas separator is generally referred to by the reference numeral 10. Generally, the shale-gas separator 10 is adapted to be in air/fluid communication with a well 12 that extends through a formation 14. FIG. 1 illustrates shale debris, dust, gas, and fluid being communicated to the shale-gas separator 10 in a pipe 16. The fluid is typically water, mist, foam, detergent or aerated mud. The shale-gas separator 10 receives the shale-gas-fluid mixture at an intake pipe 18. The intake pipe 18 is secured to and protrudes through a wall of a vessel 20. An optional dust eliminator 22 is illustrated as being directly connected to the intake pipe 18. However, the dust eliminator 22 may also be positioned in-line with the pipe 16. Regardless, the separator 10 separates the debris from the gas and communicates the debris through a discharge line 24 and a diffuser system 26 and into a receptacle 28.

Figure 2:
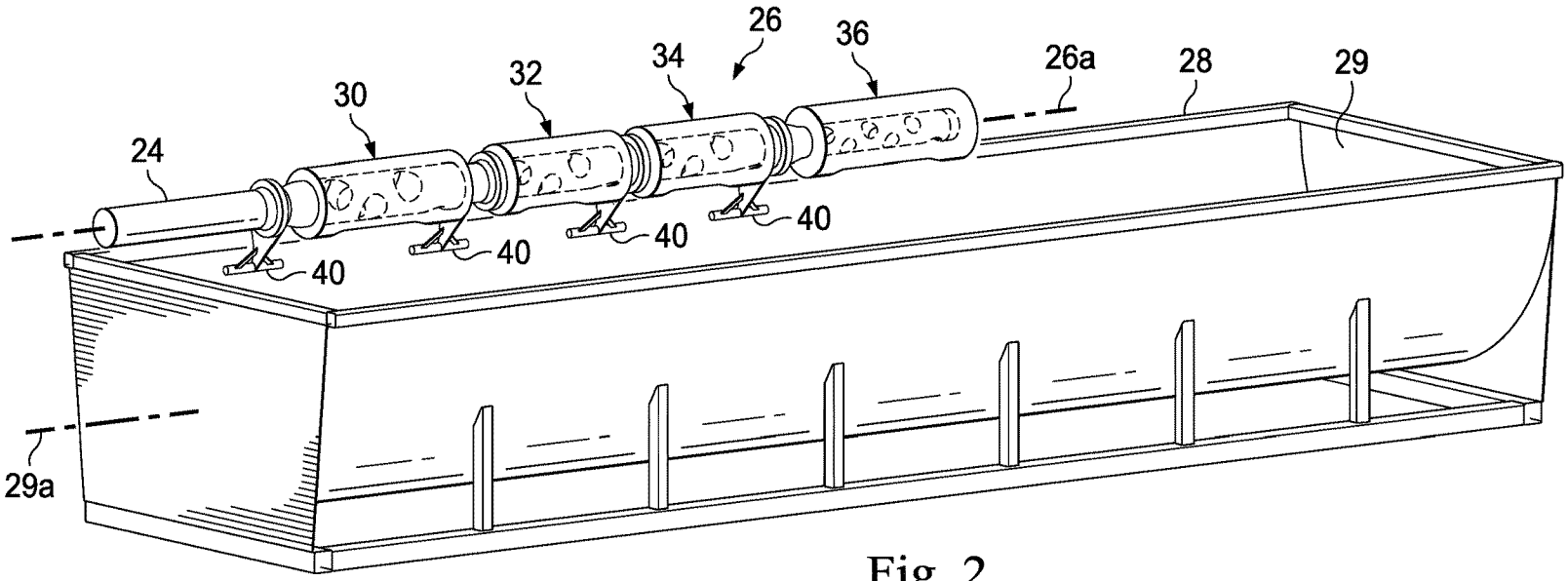
FIG. 2 is a perspective view of the discharge line, the diffuser system, and the receptacle of FIG. 1, according to an exemplary embodiment.
Figure 3:
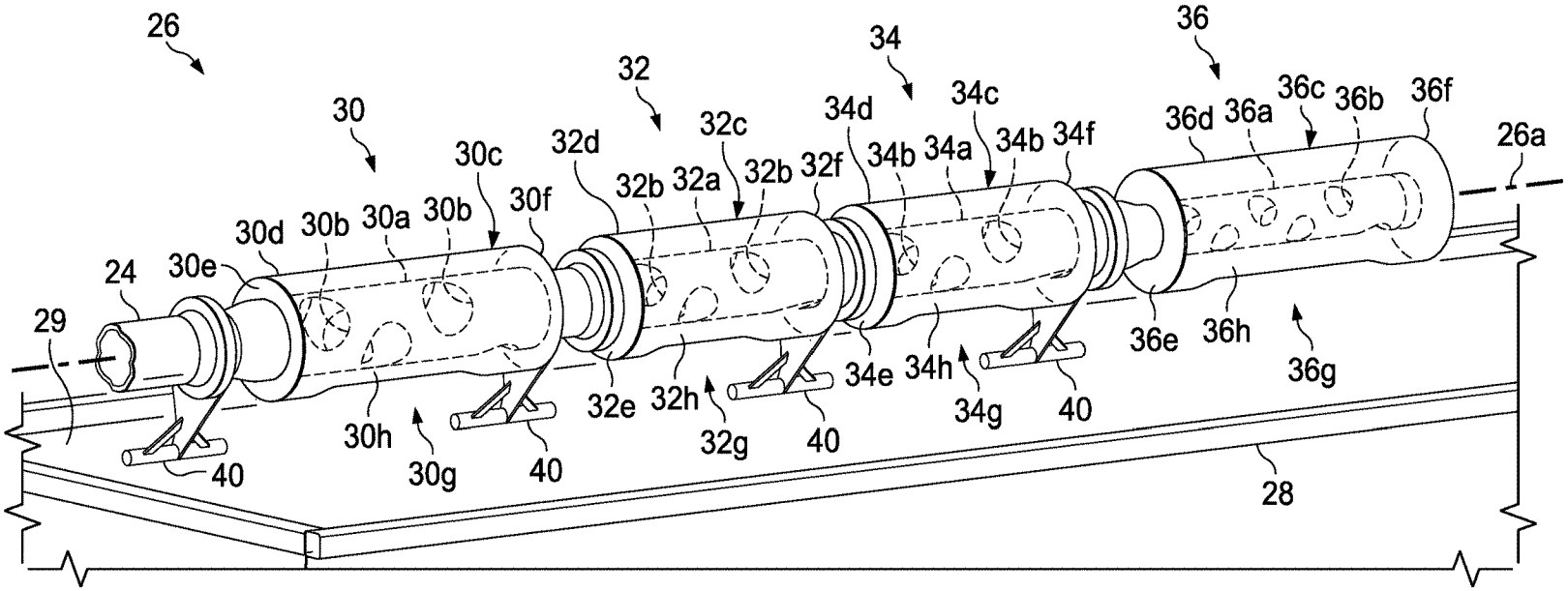
FIG. 3 is an enlarged perspective view of a portion of the discharge line, the diffuser system, and the receptacle of FIG. 2, according to an exemplary embodiment.

In an exemplary embodiment, as illustrated in FIGS. 2 and 3 with continuing reference to FIG. 1, the diffuser system 26 is positioned over the receptacle 28 that is a collection bin 29. The diffuser system 26 is in communication with a discharge outlet, or the discharge line 24, of the shale-gas separator 10. The diffuser system 26 may include a first diffuser 30, a second diffuser 32, a third diffuser 34, and a fourth diffuser 36. However, the diffuser system 26 may include any number of diffusers. Generally, the first, second, third, and fourth diffusers 30, 32, 34, and 36 are arranged in series. In other embodiments, diffusers of the diffuser system 26 may be arranged in parallel. In an exemplary embodiment, the collection bin 29 has a longitudinal axis 29*a* (shown in FIG. 2).

In an exemplary embodiment, the first diffuser 30 includes a pipe 30*a* having a plurality of openings 30*b* formed therein. The pipe 30*a* defines an inner diameter and an interior passageway. The plurality of openings 30*b* are circumferentially and axially spaced along the pipe 30*a*. That is, the plurality of openings 30*b* may be located anywhere along the length and circumference of the pipe 30*a*. While the plurality of openings 30*b* are shown as circles, any variety of shape may be formed, such as, for example, a triangle, a square, a hexagon or any other polygon, an oval, a star, etc. In one or more exemplary embodiments, the area formed by one opening from the plurality of openings is a function of the inner diameter of the pipe 30*a*. In another exemplary embodiment, the area formed by one opening from the plurality of openings is a function of the number of openings in the plurality of openings 30*b*, the length of the pipe 30*a*, and/or the expected velocity of debris that exits from the discharge line 24. For example, the area of the one opening from the plurality of openings may be substantially equal to (within 10%) or less than the cross-sectional area of the inner diameter of the pipe 30*a*.

The first diffuser 30 also includes a housing 30*c* having a tubular or cylindrical wall 30*d*, a first end cap 30*e* that extends radially from the wall 30*d* to the pipe 30*a* and a second opposing end cap 30*f* that extends radially from the wall 30*d* to the pipe 30*a*. While a cylindrical wall 30*d* is shown, a cross-section of the housing 30*c* may form a variety of shapes such as a square, a rectangle, an oval, etc. In an exemplary embodiment, an outlet 30*g* is formed in the wall 30*d* of the housing 30*c*. The outlet 30*g* may be an oblong or elongated opening that is formed along a length (measured along the longitudinal axis) of the housing 30*c*.

The first diffuser 30 also includes a first region 30*h* formed between the pipe 30*a* and the housing 30*c*. In an exemplary embodiment, the first region 30*h* is an annulus. In an exemplary embodiment, the first and second end caps 30*e* and 30*f* at least partially define the first region 30*h*. In an exemplary embodiment, the first region 30*h* is in communication with the passageway of the pipe 30*a* via the first plurality of openings 30*b*.

In an exemplary embodiment, each of the second diffuser 32, the third diffuser 34, and the fourth diffuser 36 is substantially similar to the first diffuser 30 and therefore the second diffuser 32, the third diffuser 34, and the fourth diffuser 36 will not be described in further detail. Reference numerals used to refer to the features of each of the second diffuser 32, the third diffuser 34, and the fourth diffuser 36 that are substantially identical to the features of the first diffuser 30 will correspond to the reference numerals used to refer to the features of the first diffuser 30 except that the prefix for the reference numerals used to refer to the features of the first diffuser 30, that is, 30, will be replaced by the prefix of each of the second diffuser 32, the third diffuser 34, and the fourth diffuser 36, that is, 32, 34, and 36. However, in an exemplary embodiment, the inner diameter of the pipe 32*a* is equal to or less than the inner diameter of the pipe 30*a*, the inner diameter of the pipe 34*a* is equal to or less than the inner diameter of the pipe 32*a*, and the inner diameter of the pipe 36*a* is equal to or less than the inner diameter of the pipe 34*a*. That is, the inner diameter of the pipes 30*a*, 32*a*, 34*a*, and 36*a* progressively decreases along a length of the diffuser system 26 in a direction from a first end of the diffuser system 26 that is coupled to the discharge line 24 and towards an opposing second end of the diffuser system 26. Considering the area of one opening from the plurality of openings 32*b*, 34*b*, and 36*b* is a function of the inner diameter of the pipes 32*a*, 34*a*, and 36*a*, respectively, the area of the one opening from the plurality of openings 32*b*, 34*b*, and 36*b* also progressively decreases. Additionally, a length of the pipe 36*a* may be less than the length of the housing 36*c* so that the end cap 36*f* of the housing may not contact the pipe 36*a*, as shown in FIGS. 2 and 3. Instead, a capped fitting may be coupled to the end of the pipe 36*a* and the cap 36*f* may be a solid circular end cap.

In an exemplary embodiment, each of the diffusers 30, 32, 34, and 36 is configured to couple to another of the diffusers 30, 32, 34, and 36. That is, each of the diffusers 30, 32, 34, and 36 is modular and can be "mixed and matched" to form a diffuser system 26 having a variety of lengths. For example, the diffuser system 26 may only include the first diffuser 30 and the second diffuser 32 or may include each of the diffusers 30, 32, 34, and 36 in addition to additional diffusers not shown, depending on, for example, a length of collection bin 29, an expected amount of debris from a well, an expected shale-gas-fluid mixture, and the like. Inner diameters of any additional diffusers can, but are not required to, progressively decrease along a length of the diffuser system 26 in a direction from the first end of the diffuser system 26 that is coupled to the discharge line 24 and towards the opposing second end of the diffuser system 26. The diffusers 30, 32, 34, and 36 may be detachably coupled to another of the diffusers 30, 32, 34, and 36 in a variety of ways. For example, the pipe 30*a* may have a flanged fitting or be otherwise connected to a flanged fitting that corresponds with a flanged fitting of the pipe 32*a*. Thus, when the flanged fittings are coupled together, the passageway of the pipe 30*a* and the passageway of the pipe 32*a* are in communication. In an exemplary embodiment, the first diffuser 30 is coupled to the discharge line 24 in a similar manner, such as through the use of a flanged fitting. However, a threaded connection, a snap fitting, or other similar type of fittings may be used to couple the diffusers 30, 32, 34, and 36 to one another or to the discharge line 24. As shown, the passageway defined by the pipe 30*a* is in communication with the discharge line 24; the passageway of the pipe 32*a* of the second diffuser 32 is in communication with the discharge line 24 via the passageway defined by the pipe 30*a*; the passageway of the pipe 34*a* of the third diffuser 34 is in communication with the discharge line 24 via the passageway defined by the pipe 30*a* and 32*a*, and so on.

In an exemplary embodiment, the diffuser system 26 has a longitudinally extending axis 26*a*. The diffusers 30, 32, 34, and 36 are spaced such that the outlets 30*g*, 32*g*, 34*g*, and 36*g* are also spaced along the longitudinal axis 26*a* of the diffuser system 26. In an exemplary embodiment, the system 26 has connectors 40 that secure the system 26 relative to the collection bin 29. The connectors 40 secure the system 26 to a wall of the collection bin 29 at a location that is offset from a center line that generally coincides with the longitudinal axis 29*a* of the collection bin 29. In an exemplary embodiment, the diffuser system 26 is offset from the center line by a percentage that is between 20-50% of the width of the collection bin 29. Additionally, the connectors 40 secure the system 26 such that the outlets 30*g*, 32*g*, 34*g*, 36*g* are spaced along the length of the collection bin 29.

Figure 4:
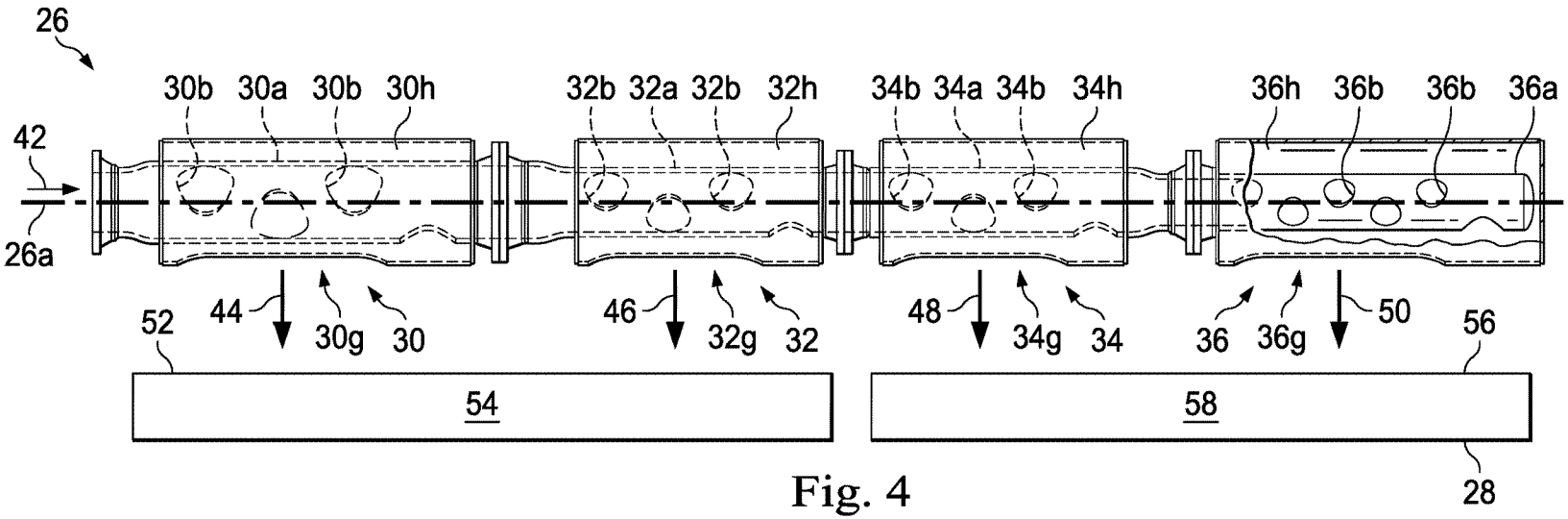
FIG. 4 is a side view of the diffuser system and the receptacle of FIG. 1, according to an exemplary embodiment.

In operation and in an exemplary embodiment, the diffuser system 26 receives debris from the discharge line 24 in the direction indicated by the numeral 42 in FIG. 4. The debris flows into the passageway of the pipe 30*a* from the discharge line 24. In an exemplary embodiment, a first portion of the debris exits the passageway of the pipe 30*a* and enters the region 30*h* via the plurality of openings 30*b* in the pipe 30*a*. The first portion of the debris then exits the region 30*h* via the outlet 30*g* as indicated by the numeral 44. In an exemplary embodiment, the first portion of the debris exits the outlet 30*g* at a first velocity. Some of the debris that enters the passageway of the pipe 30*a* does not exit the passageway via the plurality of openings 30*b*. Instead, a second portion exits the passageway of the pipe 30*a* to enter the passageway of the pipe 32*a*. The second portion of the debris exits the passageway of the pipe 32*a* and enters the region 32*h* via the plurality of openings 32*b* in the pipe 32*a*. The second portion of the debris then exits the region 32*h* via the outlet 32*g* as indicated by the numeral 46. In an exemplary embodiment, the second portion of the debris exits the outlet 32*g* at a second velocity. This process is repeated such that a third portion of the debris exits the outlet 34*g* as indicated by the numeral 48 at a third velocity and a fourth portion of the debris, or the remainder of the debris that enters the system 26, exits the outlet 36*g* as indicated by the numeral 50 at a fourth velocity. In an exemplary embodiment, the progressive reduction of inner diameter of the pipes 30*a*, 32*a*, 34*a*, and 36*a*, and/or the size of the plurality of openings 30*b*, 32*b*, 34*b*, and 36*b* balances the air flow within each of the diffusers 30, 32, 34, and 36; encourages the first, second, third, and fourth velocities to be substantially similar (equal to or within 50%); and/or reduces each of the first, second, third, and fourth velocities. For example, the first velocity may be approximately 29 ft/s, the second velocity may be approximately 22 ft/s, the third velocity may be approximately 32 ft/s, and the fourth velocity may be approximately 33 ft/s. Thus, the first, second, third, and fourth velocities are within 50% considering the difference between the fastest velocity (33 ft/s) and the slowest velocity (22 ft/s) is 11 ft/s. In an exemplary embodiment, the variations in the inner diameters of the pipes 30*a*, 32*a*, 34*a*, and 36*a*, and the size of the plurality of openings 30*b*, 32*b*, 34*b*, and 36*b* control the air flow passing through the diffuser system 26. Generally, the inner diameter of the pipe 30*a* is larger than the inner diameter of the pipes

32*a*, 34*a*, and 36*a* because the inner diameter of the pipe 30*a* is sized to accommodate the sum total airflow rates of the pipes 30*a*, 32*a*, 34*a*, and 36*a*. Similarly, the inner diameter of the pipe 32*a* is generally larger than the inner diameter of the pipes 34*a* and 36*a* because the pipe 32*a* is sized to accommodate the sum total airflow rates of the pipes 32*a*, 34*a*, and 36*a* and so on for pipes 34*a* and 36*a*. However, and as shown, the inner diameter of the pipes 32*a* and 34*a* may be equal. In an exemplary embodiment, when the inner diameter of the pipes 32*a* and 34*a* are equal, the area of one opening in the plurality of openings 34*b* is less than the area of one opening in the plurality of openings 32*b*. In an exemplary embodiment, the housing 30*c* reduces the first velocity due to the wall 30*d* and the end caps 30*e* and 30*f* blocking or deflecting the debris that exits the plurality of openings 30*b*. In an exemplary embodiment, the end caps 30*e* and/or 30*f* may block or deflect debris that is exiting the plurality of openings 30*b*, which also encourages the exit velocities to be substantially similar and/or reduced. Slowing the exit velocities reduces the likelihood of debris ricocheting off a bottom or the wall of the collection bin 29 and into an area outside of the collection bin 29. Slowing the exit velocities may also reduce the likelihood of debris from entering the collection bin 29 with a force sufficient to splash or eject debris, which is already disposed in the collection bin 29, from the collection bin 29 to a location outside the collection bin 29. Thus, the system 26 may prevent or at least reduce the likelihood of the debris damaging or dirtying surrounding equipment, posing a danger to nearby personnel, creating slip hazards, and creating a hazardous air quality condition. In an exemplary embodiment, the spacing of the outlets 30*g*, 32*g*, 34*g*, and 36*g* along the length of the collection bin 29 encourages the equal distribution of debris along the length of the collection bin 29. This may, in turn, enable the collection bin 29 to collect an additional amount of debris without being emptied or increase the time interval between emptying the collection bin.

In several exemplary embodiments, the diffuser system 26 reduces the likelihood of ricocheting debris, which in turn, reduces man hours required to clean surrounding equipment, reduces the amount of nearby equipment damaged by ricocheting debris, and ensures that the collection bin 29 is efficiently filled (i.e., debris is distributed along the length of the collection bin 29). Additionally, the connectors 40 secure the diffuser system 26 such that the diffuser system 26 is located near or close to the wall of the collection bin 29 so that a front end loader or other piece of equipment may extend within the collection bin 29 even while the diffuser system 26 extends along the length of the collection bin 29. That is, the diffuser system 26 is located flush against, or close to flush against, the wall of the collection bin 29 and does not interfere with the cleaning out or removal of the debris from the collection bin 29.

In several exemplary embodiments and as shown in FIG. 4, the receptacle 28 may be one or more shakers and the diffuser system 26 is positioned over the one or more shakers. Specifically, the outlets 30*g* and 32*g* may be positioned above an inlet 52 of a first shaker 54 and the outlets 34*g* and 36*g* may be positioned above an inlet 56 of a second shaker 58. However, when only the first diffuser 30 and the second diffuser 32 form the diffuser system 26, the outlet 30*g* may be positioned over an inlet 56 of the first shaker 54 and the outlet 32*g* may be positioned over the inlet 56 of the second shaker 58 such that the debris exiting the outlet 30*g* is received in the first shaker 54 and the debris exiting the outlet 32*g* is received in the second shaker 58. Any number of diffusers and shakers may be combined. In an exemplary embodiment, distributing the debris across a number of shakers may extend the life of at least one of the shakers, extend the time period between maintenance activities for at least one of the shakers, etc.

Figure 5:
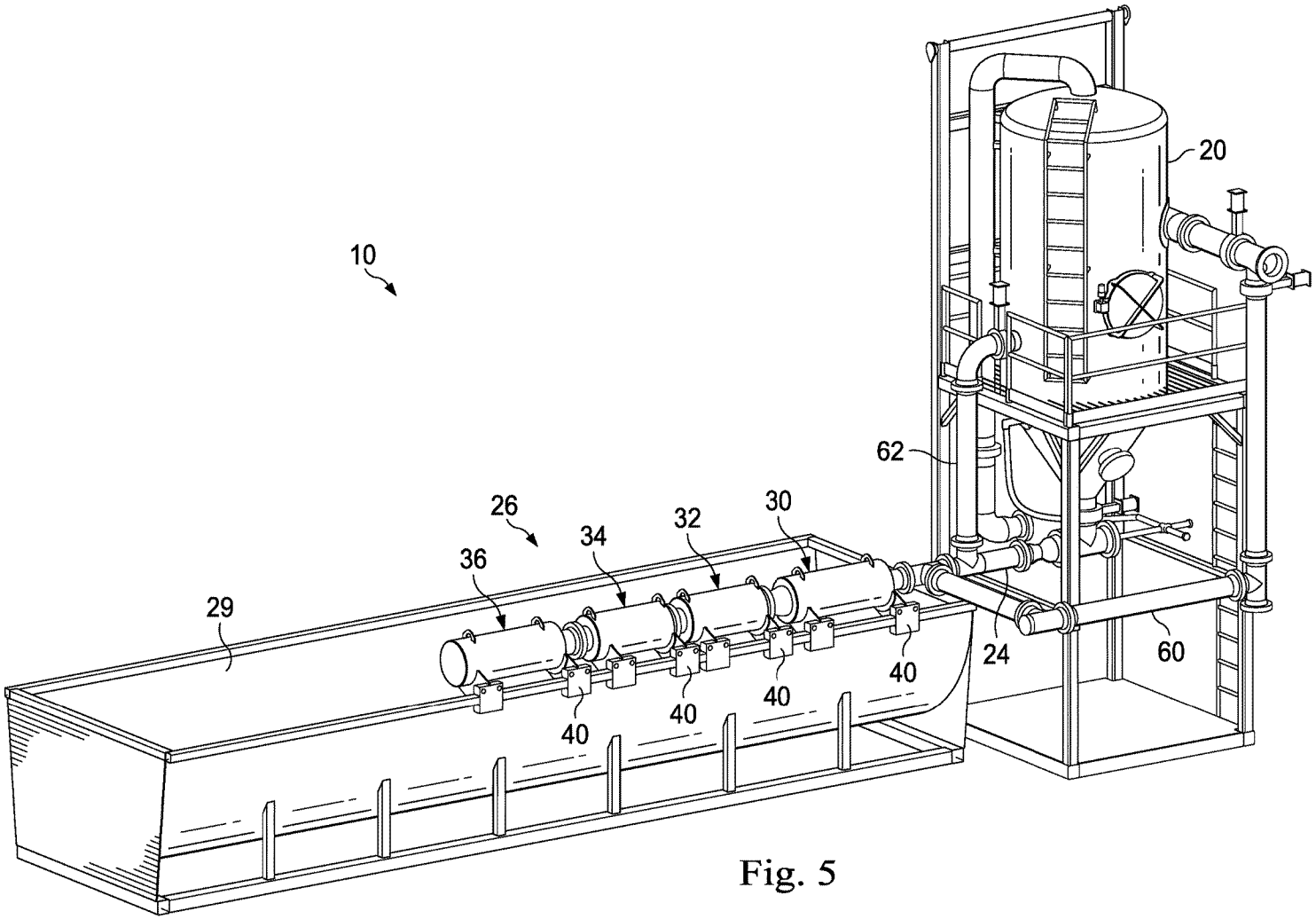
FIG. 5 is a perspective view of a separator, including a discharge line, a diffuser system, a bypass pipe, and an overflow port, according to another exemplary embodiment.

In an exemplary embodiment and as illustrated in FIG. 5, the system 26 may be coupled to and in communication with the discharge line 24; a bypass pipe 60 that is in fluid communication with the well 12; and a shale-gas separator overflow port 62. In one or more exemplary embodiments, the pipe 30*a* is adapted to be coupled to and in communication with any one or more of the discharge line 24; the bypass pipe 60 that is in fluid communication with the well 12; and the shale-gas separator overflow port 62. In an exemplary embodiment, the bypass pipe 60 may be the pipe 16 or be in communication with the pipe 16. Thus, the pipe 30*a* of the first diffuser 30 may receive debris from the well 12 via any one of the discharge line 24 of a shale-gas separator 10 that is in communication with the well 12; a bypass pipe 60 that is in communication with the well 12; and the overflow port 62 of the shale-gas separator 10.

In several exemplary embodiments, the debris may be a solid material, such as pieces of shale, fluids such as downhole fluids, gases, and/or dust, etc.

In an exemplary embodiment, the receptacle 28 may be a collection bin, a dumpster, an intake for a piece of equipment that is adapted to process or store debris that exits the discharge separator system 10 or the well 12, such as, for example, a shaker, or any other similar piece of equipment.

Figure 6A:
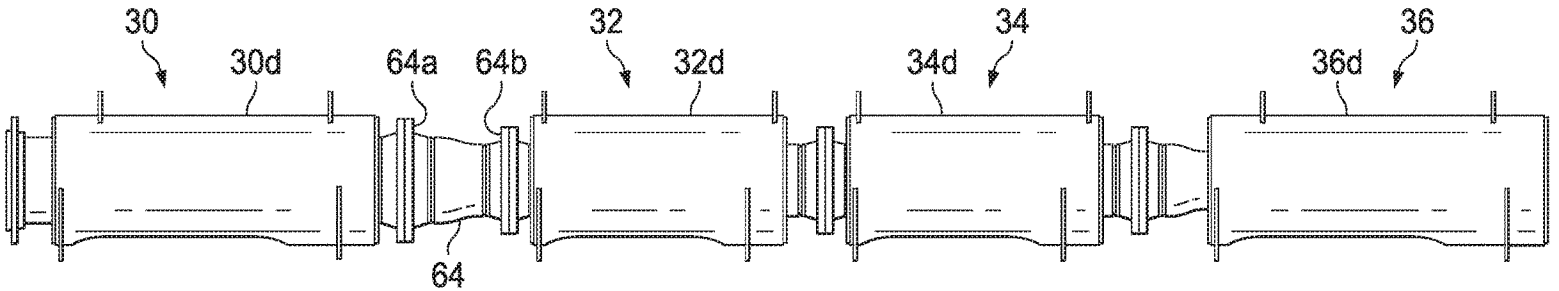
FIG. 6A is a side view of another embodiment of the diffuser system of FIG. 1, according to an exemplary embodiment.
Figure 6B:
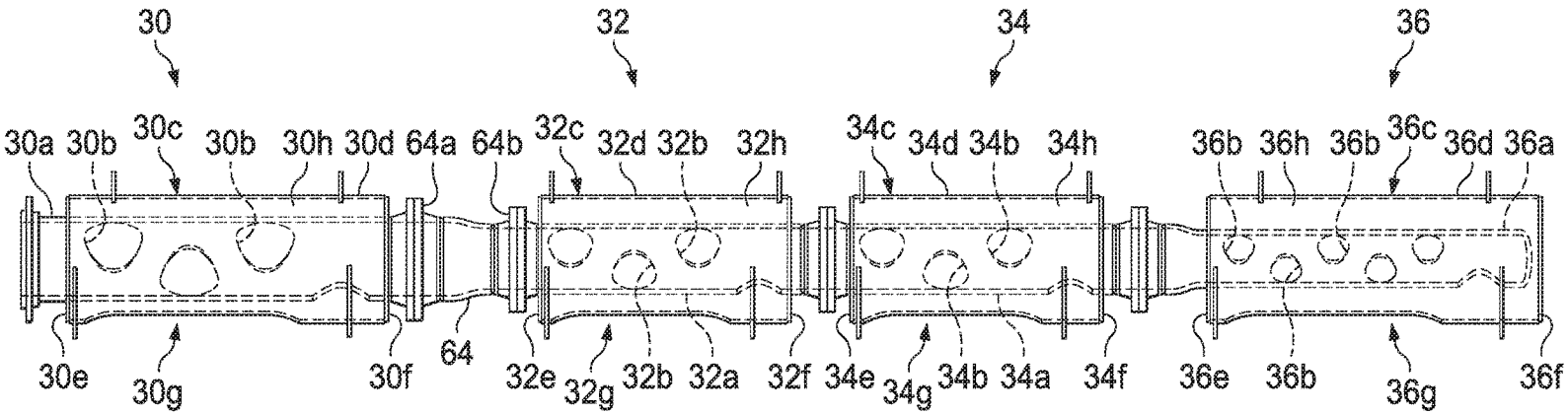
FIG. 6B is another side view of the diffuser system of FIG. 6A, according to an exemplary embodiment.

Exemplary embodiments of the present disclosure can be altered in a variety of ways. For example, and in an exemplary embodiment illustrated in FIGS. 6A and 6B, a double flanged reducer 64 forms a portion of the system 26 and is placed between any two of the diffusers 30, 32, 34, and 36. As shown in FIGS. 6A and 6B, the double flanged reducer 64 is coupled to each of the diffusers 30 and 32. In an exemplary embodiment, a flange 64*a* on one end portion of the reducer 64 is coupled to the pipe 30*a* of the diffuser 30 and another flange 64*b* on an opposing end portion of the reducer 64 is coupled to the pipe 32*a* of the diffuser 32. That is, and as shown in FIGS. 6A and 6B, the double flanged reducer 64 couples the first pipe 30*a* to the second pipe 32*a* such that the first passageway of the first pipe 30*a* is in communication with the second passageway of the second pipe 32*a*. Generally, the reducer 64 provides "back pressure," which keeps, at least in part, uniformly low discharge velocities thereby at least in part reducing the likelihood of the debris damaging or dirtying surrounding equipment, posing a danger to nearby personnel, creating slip hazards, and creating a hazardous air quality condition. The reducer 64 also provides a transition between the pipes 30*a* and 32*a* when the inner diameter of the pipes 30*a* and 32 are not the same. Moreover, the reducer 64 also provides for proper placement of the outlets 30*g*, 32*g*, 34*g*, and 36*g* along the length of the diffuser system 26 and/or the collection bin 29. Moreover, as the majority of wear and wash out occurs in the reducer 64, the flanges 64*a* and 64*b* allow the reducer 64 itself to be quickly changed out, reducing down time and material cost over changing out one of the diffusers 30, 32, 34, and 36.

Additionally, and for example, and in one embodiment in which the flow rate and/or velocity of the debris exiting the discharge line 24 or the well 12 is low, the fourth velocity of the debris that exits the outlet 36*g* may be zero or close to zero. Additionally, in another exemplary embodiment, instead of each diffuser 30, 32, 34, and 36 having an individual housing 30*c*, 32*c*, 34*c*, and 36*c*, a housing may extend over each of the pipes 30*a*, 32*a*, 34*a*, and 36*a* with any number of outlets formed in the housing. In another embodiment, the diffuser system 26 may include only the diffuser 30 in which the inner diameter of the pipe 30*a* remains constant. In an exemplary embodiment, the size of the plurality of openings 30*b* is progressively reduced, with larger sized openings associated with the first end of the diffuser system 26 that is attached to the discharge line 24 and smaller sized openings associated with the opposing second end. Additionally, an insert having a progressively larger outer diameter may be extended within the passageway of the pipe 30*a* and from the second end of the diffuser system 26 such that that the insert has an outer diameter at the second end that is larger than the outer diameter that is near the first end. The housing 30*c* may include a plurality of outlets 30*g*.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and "right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the disclosure(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A discharge diffuser apparatus, the discharge diffuser apparatus comprising:

a first pipe having a first plurality of openings formed therein, the first pipe defining a first passageway that is adapted to receive debris discharged from a well;

a first housing within which the first pipe extends, the first housing comprising a first wall and a first outlet formed therein; and a first region formed between the first pipe and the first housing, the first region being in communication with the first passageway via the first plurality of openings;

wherein the first pipe has an axial length that is greater than an axial length of the first housing;

wherein the first plurality of openings are circumferentially and axially spaced along the first pipe to pass a first portion of the debris from the first passageway to the first region; and wherein the first outlet is sized such that the first portion of the debris exits the first region via the first outlet.

2. The discharge diffuser apparatus of claim 1, wherein one opening from the first plurality of openings defines a first area;

wherein the first pipe defines a first inner diameter; and wherein the first area is a function of the first inner diameter.

3. A discharge diffuser apparatus, the discharge diffuser apparatus comprising:

a first pipe having a first plurality of openings formed therein, the first pipe defining a first passageway that is adapted to receive debris discharged from a well;

a first housing within which the first pipe extends, the first housing comprising a first wall and a first outlet formed therein; and a first region formed between the first pipe and the first housing, the first region being in communication with the first passageway via the first plurality of openings;

wherein the first plurality of openings are circumferentially and axially spaced along the first pipe to pass a first portion of the debris from the first passageway to the first region;

wherein the first outlet is sized such that the first portion of the debris exits the first region via the first outlet;

wherein the first housing comprises:

a first end cap that extends radially between the first wall of the first housing and the first pipe; and a second opposing end cap that extends radially between the first wall of the first housing and the first pipe; and wherein the first and second end caps at least partially define the first region.

4. A discharge diffuser apparatus, the discharge diffuser apparatus comprising:

a first pipe having a first plurality of openings formed therein, the first pipe defining a first passageway that is adapted to receive debris discharged from a well;

a first housing within which the first pipe extends, the first housing comprising a first wall and a first outlet formed therein; and a first region formed between the first pipe and the first housing, the first region being in communication with the first passageway via the first plurality of openings;

wherein the first plurality of openings are circumferentially and axially spaced along the first pipe to pass a first portion of the debris from the first passageway to the first region;

wherein the first outlet is sized such that the first portion of the debris exits the first region via the first outlet;

wherein one opening from the first plurality of openings defines a first area;

wherein the first pipe defines a first inner diameter;

wherein the first area is a function of the first inner diameter;

wherein the discharge diffuser apparatus further comprises:

a second pipe having a second plurality of openings formed therein, the second pipe defining a second passageway that is adapted to receive debris that is discharged from the well;

a second housing within which the second pipe extends, the second housing comprising a second wall and a second outlet formed therein; and a second region formed between the second pipe and the second housing, the second region being in communication with the second passageway via the second plurality of openings;

wherein the second plurality of openings are circumferentially and axially spaced along the second pipe to pass a second portion of the debris from the second passageway to the second region; and wherein the second outlet is sized such that the second portion of the debris exits the second region via the second outlet.

5. The discharge diffuser apparatus of claim 4, wherein one opening from the second plurality of openings defines a second area that is less than the first area;

wherein the second pipe defines a second inner diameter that is less than the first inner diameter; and wherein the second area is a function of the second inner diameter.

6. The discharge diffuser apparatus of claim 4, wherein the first outlet and the second outlet are arranged in series and are spaced along a length of a collection bin that is configured to receive the first portion of the debris and the second portion of the debris.

7. The discharge diffuser apparatus of claim 4, wherein the first outlet and the second outlet are arranged in series and spaced such that the first outlet is positioned above an inlet of a first shaker and the second outlet is positioned above an inlet of a second shaker.

8. The discharge diffuser apparatus of claim 4, wherein the first pipe is adapted to be detachably coupled to the second pipe and the second pipe is adapted to be detachably coupled to the first pipe; and wherein the discharge diffuser apparatus further comprises a double flanged reducer that detachably couples the first pipe to the second pipe.

9. The discharge diffuser apparatus of claim 1, wherein the discharge diffuser apparatus is adapted to be coupled to one or more of the following:

a discharge outlet of a shale-gas separator that is in communication with the well;

a bypass pipe that is in communication with the well; and an overflow port of the shale-gas separator; and wherein the first passageway is in communication with one or more of the following:

the discharge outlet of the shale-gas separator;

the bypass pipe; and the overflow port of the shale-gas separator.

10. A debris discharge diffuser system, the system comprising:

a first diffuser adapted to be in communication with a well, the first diffuser comprising:

a first pipe having a first plurality of openings formed therein and defining a first passageway that is adapted to receive debris that is discharged from the well;

a first housing within which the first pipe extends, the first housing comprising a first wall and a first outlet formed therein; and a first region formed between the first pipe and the first housing, the first region being in communication with the first passageway via the first plurality of openings;

wherein the first region is adapted to receive a first portion of the debris that is discharged from the well via the first plurality of openings;

a second diffuser adapted to in communication with the well via the first diffuser, the second diffuser comprising:

a second pipe having a second plurality of openings formed therein and defining a second passageway that is adapted to receive debris that is discharged from the well via the first pipe;

a second housing within which the second pipe extends, the second housing comprising a second wall and a second outlet formed therein; and a second region formed between the second pipe and the second housing, the second region being in communication with the second passageway via the second plurality of openings;

wherein the second region is adapted to receive a second portion of the debris that is discharged from the well via the second plurality of openings;

wherein the first pipe is configured to be coupled to the second pipe such that the first passageway is in communication with the second passageway; and wherein the first pipe defines a first inner diameter and the second pipe defines a second inner diameter that is less than the first inner diameter.

11. The debris discharge diffuser system of claim 10, wherein the system is adapted to be coupled to one or more of the following:

a discharge outlet of a shale-gas separator that is in communication with the well;

a bypass pipe that is in communication with the well; and an overflow port of the shale-gas separator; and wherein the first passageway is in communication with one or more of the following:

the discharge outlet of the shale-gas separator;

the bypass pipe; and the overflow port of the shale-gas separator.

12. The debris discharge diffuser system of claim 10, wherein the first plurality of openings are circumferentially and axially spaced along the first pipe to pass the first portion of the debris from the first passageway to the first region;

wherein the first outlet is sized such that the first portion of the debris exits the first region via the first outlet;

wherein the second plurality of openings are circumferentially and axially spaced along the second pipe to pass the second portion of the debris from the second passageway to the second region;

wherein the second outlet is sized such that the second portion of the debris exits the second region via the second outlet;

wherein the first diffuser and the second diffuser are arranged in series along a longitudinal axis of the debris discharge diffuser system such that the first outlet is longitudinally spaced from the second outlet; and wherein the debris discharge diffuser system further comprises:

a collection bin located below the first diffuser and the second diffuser to receive the first portion of the debris and the second portion of the debris; and a connector extending between the collection bin and at least one of the first diffuser and the second diffuser such that the first outlet and the second outlet are spaced along a length of the collection bin.

13. The debris discharge diffuser system of claim 10, further comprising a double flanged reducer that couples the first pipe to the second pipe such that the first passageway is in communication with the second passageway.

14. The debris discharge diffuser system of claim 10, wherein the first housing comprises:

a first end cap that extends radially between the first wall of the first housing and the first pipe; and a second opposing end cap that extends radially between the first wall of the first housing and the first pipe;

wherein the first and second end caps at least partially define the first region;

wherein the second housing comprises:

a third end cap that extends radially between the second wall of the second housing and the second pipe; and a fourth opposing end cap that extends radially between the second wall of the second housing and the second pipe; and wherein the third and fourth end caps at least partially define the second region.

15. The debris discharge diffuser system of claim 10, wherein one opening from the first plurality of openings defines a first area;

wherein the first area is a function of the first inner diameter;

wherein one opening from the second plurality of openings defines a second area that is less than the first area; and wherein the second area is a function of the second inner diameter.

16. The debris discharge diffuser system of claim 10, wherein the first outlet and the second outlet are arranged in series along a longitudinal axis of the debris discharge diffuser system and spaced such that the first outlet is positioned above an inlet of a first shaker and the second outlet is positioned above an inlet of a second shaker.

* * * * *